US009930953B2

(12) United States Patent
Liard et al.

(10) Patent No.: US 9,930,953 B2
(45) Date of Patent: Apr. 3, 2018

(54) CONTAINER FOR COSMETIC PRODUCT, PROVIDED WITH TELESCOPIC MOVEMENT MEANS

(71) Applicant: ALBEA SERVICES, Gennevilliers (FR)

(72) Inventors: Jerome Liard, Sainte-Jamme-sur-Sarthe (FR); Frederic Lecureuil, Neuville sur Sarthe (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 15/238,252

(22) Filed: Aug. 16, 2016

(65) Prior Publication Data

US 2017/0049211 A1 Feb. 23, 2017

(30) Foreign Application Priority Data

Aug. 18, 2015 (FR) ..... 15 57799

(51) Int. Cl.
*A45D 40/06* (2006.01)
*A45D 40/04* (2006.01)

(52) U.S. Cl.
CPC ..... *A45D 40/06* (2013.01); *A45D 40/04* (2013.01)

(58) Field of Classification Search
CPC ..... A45D 40/02; A45D 40/04; A45D 40/06
See application file for complete search history.

(56) References Cited

U.S. PATENT DOCUMENTS 5,172,993 A 12/1992 Ackermann et al.
5,653,338 A * 8/1997 Tani ..... A45D 40/04 206/385
2005/0163554 A1* 7/2005 Cara Sanchez ..... A45D 40/04 401/69

FOREIGN PATENT DOCUMENTS

JP S5541151 A 3/1980
JP H10117841 A 5/1998

OTHER PUBLICATIONS

Jun. 29, 2016—(FR) Search Report—App 1557799.

* cited by examiner

*Primary Examiner* — Jennifer C Chiang
*Assistant Examiner* — Bradley Oliver
(74) *Attorney, Agent, or Firm* — Banner & Witcoff, Ltd.

(57) ABSTRACT

A container for cosmetic product has a receptacle provided with an inner space and having a cup designed to receive the product. The container also has means that are intended for moving the cup and are provided with a first part and a second part which are coaxial with the cup along an axis of the receptacle. The cup, the first part, and the second part are interlinked in a telescopic movement along the axis.

12 Claims, 3 Drawing Sheets

CONTAINER FOR COSMETIC PRODUCT, PROVIDED WITH TELESCOPIC MOVEMENT MEANS

CROSS-REFERENCE TO RELATED APPLICATIONS

The present application claims priority to French Patent Application No. 1557799 filed Aug. 18, 2015. The present application claims priority to and the benefit the above-identified application, which is incorporated by reference herein in its entirety.

FIELD OF THE INVENTION

The invention relates to a container for cosmetic product, provided with telescopic movement means. The invention relates more particularly to a container, in particular for a stick of cosmetic product, in particular a lipstick.

BACKGROUND

The field of cosmetics is a field that requires innovative and original products to be created so that they differ from the competition and are attractive, and also so that they cater for trends or fashions that evolve in society and to which the consumers are sympathetic, in particular with regard to lipsticks. Therefore, it is known to provide such containers having a body provided with an opening that can be closed using a removable cover.

Such containers further comprise a mechanism for moving a cup relative to the body, said cup carrying the stick of cosmetic product. The movement mechanism in particular consists of movement means provided with a guide for the cup mounted inside the body. Said means make it possible for the cup to be driven in order to retract the stick of cosmetic product inside the container, or to be extended therefrom to make it accessible to a user who wishes to apply make-up. Therefore, the cup may be moved between a storage position in which it is inserted into the body and an application position in which the cup is substantially at the level of the opening in the body so that a large portion of the stick is outside the receptacle.

In known movement means, the cup is actuated by a rotational movement of the body relative to the guide, the guide being mechanically held by means of a twist portion that is accessible from the outside of the body and is arranged at the end opposite the opening. The guide is present substantially over the entire height of the body in order to be able to guide the cup to the opening. Furthermore, a thread is also present over the entire height of the body in order to move the cup. However, the thread and the guide, which generally comprises at least one slide, take up a certain thickness in the inner circumference of the body. This thickness therefore reduces the diameter of the stick of cosmetic product that can be used with such a receptacle.

In order to avoid having a guide present over the height of the body, there are movement means that are arranged only on the inner portion of the body. They are provided with a part that rotates relative to the body. The rotatable part is mechanically connected to the twist portion and is provided with a thread. The cup further comprises a shaft that can move in the rotatable part by interacting with the thread, the cup being moved in translation along the body when the rotatable part is actuated, by locking the rotation of the cup relative to the body.

However, in order to be able to move the cup as far as the opening in the container, the length of the thread has to be substantially equal to the distance between the storage position of the cup and the application position. The body therefore has to have a height that is twice as great as the length of the stick of cosmetic product. Therefore, the movement means are important with regard to the height of the body. The length of the stick of cosmetic product is therefore limited to substantially half the height of the body, which therefore has to be long enough to accommodate a standard stick of cosmetic product.

SUMMARY

Therefore, there are in fact no containers for cosmetic product that are both capable of containing a wide stick of cosmetic product and that have standard dimensions. The invention therefore aims to provide a container, in particular for cosmetic product, that has both a compact mechanism for moving the cup and a body that can accommodate a wide stick of lipstick.

For this purpose, the invention relates to a container for cosmetic product, comprising a receptacle provided with an inner space, the container comprising a cup designed to receive said product, the container comprising means that are intended for moving the cup and are provided with a first part and a second part which are coaxial with the cup along an axis of the receptacle, the cup, the first part and the second part being interlinked in a telescopic movement along said axis.

The telescopic movement of the cup and the parts makes it possible to have movement means that are more compact in the receptacle when the cup is in the storage position. However, said movement means extend as far as standard movement means in the application position.

Therefore, the receptacle can contain a stick of cosmetic product that is longer while remaining a receptacle of standard size.

According to various embodiments of the invention, which can be taken together or separately:

- the container is designed so that an actuation of the receptacle relative to said second part drives a translation of the first part or the cup relative to said receptacle along said axis as far as an abutment position of the cup on the first part, then a joint translation of the cup and the first part relative to said receptacle along said axis as far as an end position of the cup,
- said cup is designed to be moved in a spiral manner along said axis relative to said first part,
- said cup, in rotation, is designed to abut said first part,
- said first part is designed to be moved in a spiral manner along said axis relative to said second part,
- said second part is rotatable relative to the body about said axis and said cup is locked in rotation about said axis relative to the body,
- the cup comprises at least one extension tab that is capable of interacting with the first part, the extension tab enabling the movement of the cup relative to the first part to be controlled,
- the first part comprises a first thread that is capable of interacting with a protuberance arranged on the extension tab, the sliding of said protuberance in the first thread controlling the movement of the cup relative to the first part, the first part and the second part are each provided with through-holes, which each open out opposite one another, the first thread being arranged on the outer surface of the first part, the tab(s) is/are located at a distance from said axis of the receptacle and said cup is provided with one or more orifices opening out opposite the holes in the first part and the second part, which enables the cup to be filled from the bottom, the first part is capable of moving between a first position in which it is substantially inserted into the second part and a second position in which it is substantially protruding from the second part, or, in a variant, the first part is capable of moving between a first position in which the second part is substantially inserted into the first part and a second position in which the second part is substantially protruding from the first part, the movement means comprise a second thread arranged on the second part, the second thread being capable of interacting with a protrusion arranged on the first part to enable the first part to move relative to the second part, said container comprises a slide that is capable of interacting with a stud arranged on the cup, the slide(s) being substantially fixed to the receptacle for rotation therewith, the protuberance and the stud are located on either side of an end of said extension tab, the tab being able to move in a space located between the movable first part and the slide, which makes it possible to provide a cup having a limited number of extensions, said container comprises a movable element provided with the slide(s), the movable element being fixed on the one hand to the first part for movement in translation therewith and fixed on the other hand to the receptacle for rotation therewith, which makes it possible for slides to be omitted in the region of the body, said movable element is provided with at least one planar surface in contact with a rim of the receptacle in order to stop it from turning inside the receptacle, the movable element is free to rotate about the first part, the movable element is arranged around the first part, the movement means are arranged at one end of the receptacle, the second part being able to be actuated from outside the receptacle, the receptacle is cylindrical, the first part and the second part are cylindrical, said container comprises a removable cover that is capable of closing the receptacle.

BRIEF DESCRIPTION OF THE DRAWINGS

The invention will be better understood on reading the following description, which is given purely by way of illustration and is not intended to limit said invention, accompanied by the following drawings.

DETAILED DESCRIPTION OF EXEMPLARY ASPECTS

Figure 1:
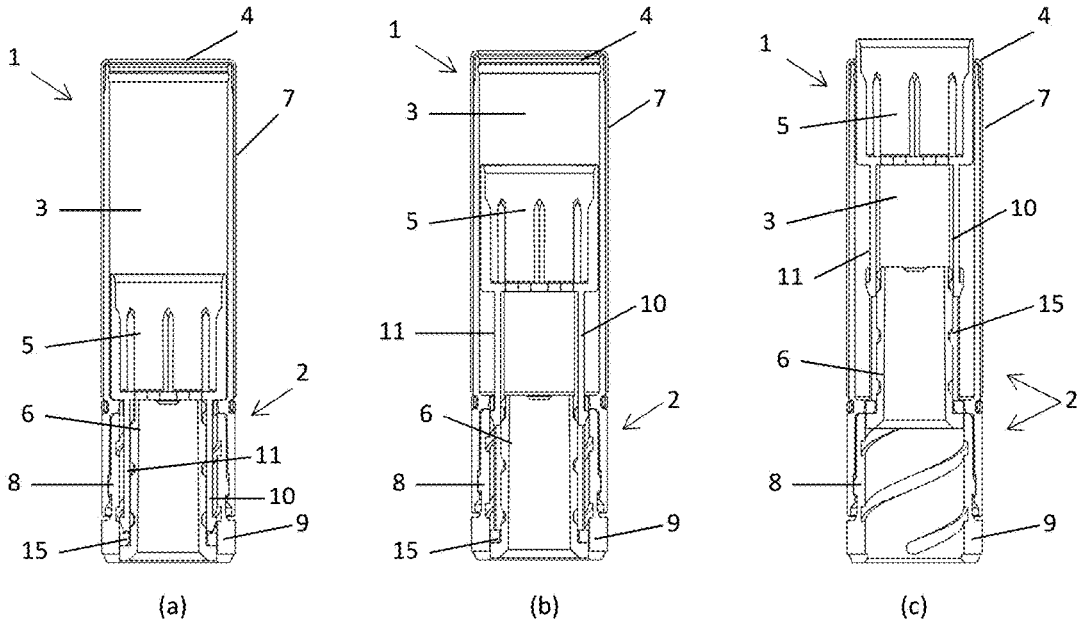
FIG. 1 is a schematic longitudinal section through a container for cosmetic product according to one embodiment of the invention, in a storage position (a), an intermediate position (b) and an application position (c) of the cup.

In FIG. 1, the invention relates to a container 1 for cosmetic product, the container 1 shown being in this case a lipstick tube. Said container 1 comprises a receptacle 3 provided with a tubular body 7 and an inner space intended to accommodate the cosmetic product, which is therefore in this case a stick of lipstick (not shown in the drawings). The inner space is substantially identical in shape to the outer shape of the stick of lipstick. The receptacle 1 is also provided with an opening 4 that makes it possible for the stick of lipstick to be moved out of the receptacle 3 so that it can be used.

Said receptacle 3 comprises a cup 5 that is designed to receive said stick of lipstick. The receptacle, in this case cylindrical, has a main axis, along which the cup 5 is capable of moving in translation in the inner space, as shown in FIGS. 1(*a*) to 1(*c*). Said receptacle 3 is designed so that the cup 5, and therefore the cosmetic product, can assume at least two positions. The first position is a storage position in which the cosmetic product is received inside the receptacle 3 (FIG. 1(*a*)), the cup being positioned at the bottom of the receptacle 3. The second position (FIG. 1(*c*)) is a position for applying the cosmetic product in which the product is substantially outside the receptacle 3, the cup 5 being positioned at the level of the opening 4 of the receptacle 3. In the case of a lipstick tube, the receptacle 3 comprises a tubular body 7 in which the cup 5 is capable of moving in one direction, referred to as the axial direction, corresponding to the axis of the body 7.

To this end, the container 1 according to the invention comprises means 2 for moving the cup 5. The movement means 2 are provided with a first part 6 and a second part 8 which are coaxial with the cup 5 along the axis of the receptacle 3. The first part 6 and the second part 8 are cylindrical and each have an outer surface. The movement means 2 are arranged at an end of the receptacle 3 opposite the opening 4. The second part is also accessible from the outside of the receptacle by means of a gripping portion 9 arranged in this case on the outer face of the second part 8.

The second part 8 is rotatable relative to the body 7 about said main axis and said cup 5 is locked in rotation about said main axis relative to the body 7. In other words, the cup 5 is fixed to the body 7 for rotation therewith and is free in translation, however the second part 8 is free to rotate relative to the body 7 but immovable in translation.

Therefore, the user of the lipstick causes the stick of lipstick to extend either by turning said gripping portion 9 relative to the body 7 of the stationary receptacle 3 or by turning the body 7 of the container 3 relative to the second part 8 while keeping the gripping portion 9 stationary. In the following description, the movements are described for the alternative in which the body 7 turns, the second part 8 and the gripping portion 9 being stationary. They could also have been described for the other alternative, without changing the result, since the same axial movement of the cup 5 in the receptacle 3 is obtained for the two alternatives.

According to the invention, as shown in FIGS. 1(*a*) to 1(*c*), the cup 5, the first part 6 and the second part 8 are interlinked in a telescopic movement along said main axis. The container 1 is designed so that an actuation of the receptacle 3 relative to said second part 8 drives a translation of the cup 5 relative to said receptacle 3 along said axis, from the storage position (FIG. 1(*a*)) to an abutment position of the cup 5 on the first part 6 into an intermediate position (FIG. 1(*b*)). In the storage position, the first part 6 is substantially inserted into the second part 8, and the cup 5 is substantially in contact with the first part 6. In the intermediate position, the first part 6 is always inserted into the second part 8, while the cup 5 is located at a distance from the first part 6 in the receptacle 3, substantially midway to the opening 4.

Figure 3:
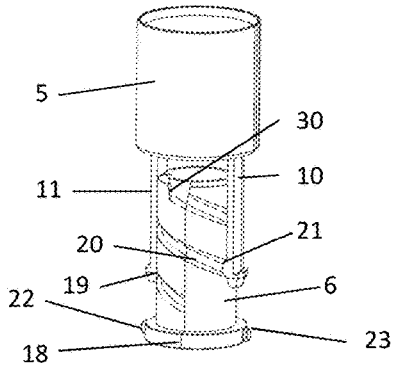
FIG. 3 is a schematic perspective view of the interaction between the cup and the first element between the storage position and the intermediate position of the container for cosmetic product according to one embodiment of the invention.

During its movement in translation in the body 7 between the storage position and the intermediate position, the cup 5 accompanies the rotational movement of the body 7, while the first part 6 remains stationary. Thus, the cup 5 is designed to be driven in a spiral movement relative to said first part 6 along said main axis, as shown in FIG. 3. For this purpose, the first part 6 is provided with a first thread 20 and the cup 5 comprises two extension tabs 10, 11. The tabs 10, 11 are capable of interacting with the first thread 20 of the first part 6, in order to control the movement of the cup 5 relative to the first part 6. The first thread 20 is arranged in this case on the outer surface of the first part 6. The extension tabs 10, 11 each comprise a protuberance 19, 21 arranged substantially at the end of the tab 10, 11 opposite the cup 5. Sliding the two protuberances 19, 21 in the first thread 20 controls the movement of the cup 5 relative to the first part 6, as shown in FIG. 3. The cup 5 therefore follows a screwing-unscrewing movement relative to the first part 6, the extension tabs 10, 11 moving between the first part 6 and the second part 8.

Furthermore, in rotation, the cup 5 is designed to abut said first part 6 in the end position, when the cup 5 is in the intermediate position. In other words, when the protuberances 19, 21 reach the end of the first thread 20, the rotational movement of the cup 5 relative to the first part is inhibited in this direction by a profiled portion 30 located at the end of the thread 20.

As shown in FIG. 1, when the receptacle 3 continues turning relative to the second part 8, the cup 5 and the first part 6 carry out a conjoint translation relative to said receptacle 3 along said main axis, from the intermediate position (FIG. 1(*b*)) to an end position of the cup, which is the application position (FIG. 1(*c*)). In the application position, the movement means 3 are extended as far as they can go. In other words, the first part 6 is substantially outside the second part 8.

As shown in FIGS. 1(*c*) and 5, said first part 6 is designed to be driven relative to said second part 8 in a spiral movement along said axis. In other words, the first part 6 is capable of moving simultaneously in rotation and in translation between a first position in which it is substantially inserted into the second part 8 and a second position in which it is substantially protruding from the second part 8. For this purpose, the second part 8 is tubular and provided with an axial hole so as to be able to accommodate the first part. The second part thus comprises a cylindrical inner surface facing the first part 6 when the cup 5 is in the storage position or in the intermediate position.

Figure 6:
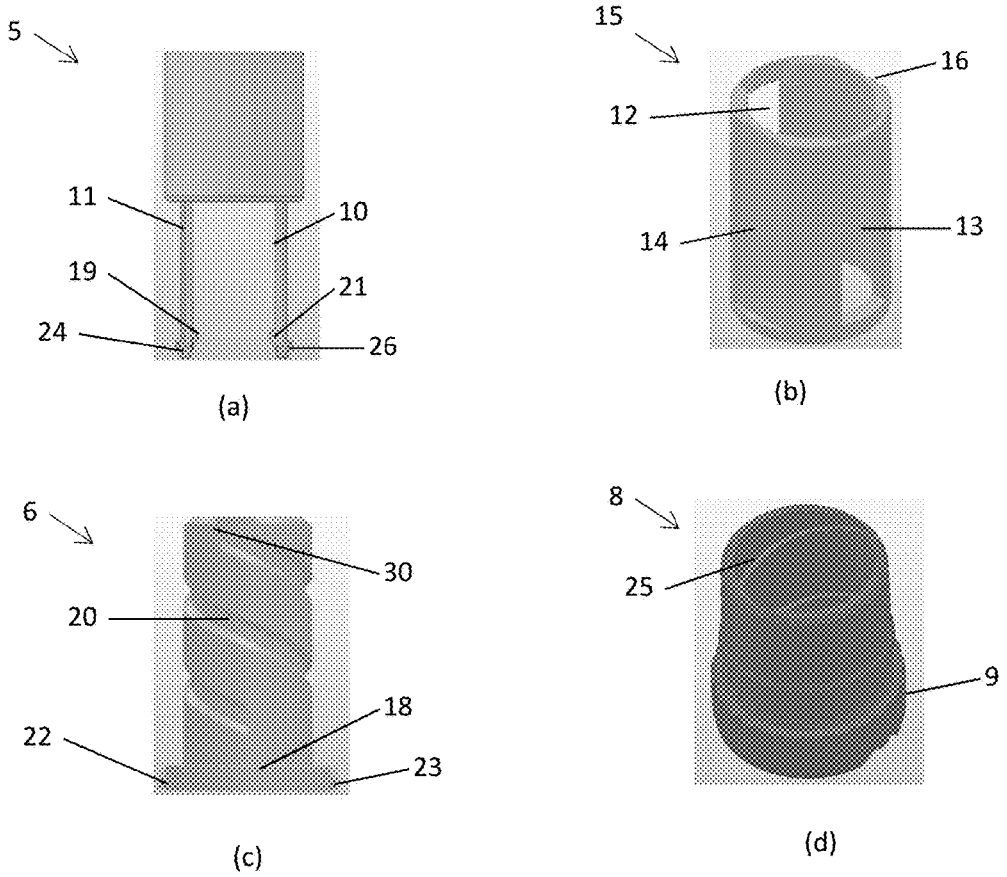
FIG. 6 shows a schematic front view of the cup (a), a schematic perspective view of the movable element (b), a schematic front view of the first part (c) and a schematic perspective view of the second part (d).

To make the spiral movement possible, the movement means 2 comprise a second thread 25 arranged on the inner surface of the second part 8, and the first part 6 comprises protrusions 22, 23, for example two protrusions, as shown in FIGS. 6(*c*) and 6(*d*). The protrusions 22, 23 are arranged in this case on the outer surface of the first part 6 below the first thread 20, preferably on a circular base 18 that is wider than the first part 6. The second thread 25 is capable of interacting with the protrusions 22, 23 so that the protrusions 22, 23 can slide in the second thread 20. The second thread 20 and the protrusions 22, 23 therefore enable the simultaneous movement in translation and in rotation of the first part 6 relative to the second part 8, as shown in FIGS. 1(*c*) and 5. The first part 6 therefore follows a screwing-unscrewing movement inside the second part 8. In this case, during this movement phase, the cup 5 moves in a conjoint manner with the first part 6 in order to reach the opening 4 in the application position.

The cup 5 is also fixed to the receptacle for rotation therewith by means of the guide means arranged in the receptacle 3. In other words, the container 1 comprises guide means that are designed to prevent the cup from rotating relative to the receptacle 3 and to guide said cup in translation. Thus, when the body 7 of the receptacle 3 turns relative to the second part 8, the cup 5 is rotated with, and in the same movement as, the body 7. The tabs 10, 11 of the cup 5 therefore turn in the first thread 20, thus generating the spiral movement of the cup 5 about the first part 6 in the receptacle 3 and the movement of the cup 5 relative to the receptacle 3 along the main axis thereof.

Figure 4:
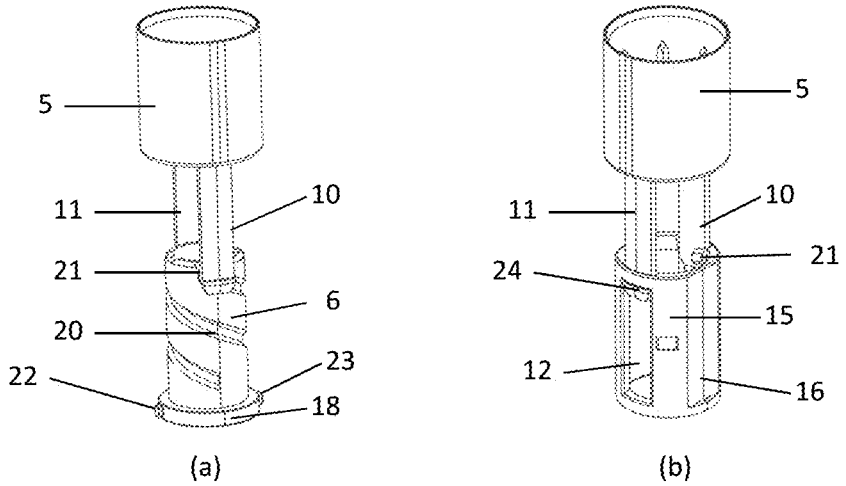
FIG. 4 is a schematic perspective view of the interaction between the cup and the first element (a) between the intermediate position and the application position, and the interaction between the cup and guide means (b)

In FIGS. 4(*b*) and 5, the guide means in this case comprise a cylindrical movable element 15 provided with two slides 12, 13 that are substantially in parallel with the axis of the receptacle 3. The movable element 15 can be in the shape of a hollow tube, the axis of which corresponds to the main axis of the receptacle 3. The slides 12, 13 are arranged on the peripheral surface of the movable element 15, preferably facing one another, and in such a way as to be able to interact with the tabs 10, 11. These are, in particular, slots that are radially open.

Between the storage position and the intermediate position, the movable element 15 turns together with the body 7 and is free to rotate about the first part 6, the first part 6 being able to turn inside the movable element 15. Between the intermediate position and the use position, the movable element 15 is rigidly connected to the first part 6 in translation and fixed thereto for rotation therewith. The movable element rests on the base 18 of the first part 6, and follows the translational movement of the first part 6 in the receptacle 3. The movable element 15 can move in translation in the receptacle 3. Thus, the movable element 15 is positioned between the first part 6 and the second part 8 in the storage position and in the intermediate position. In other words, the first part 6 is inserted into the movable element 15, which is itself inserted into the second part 8. The movable element 15 follows the movement of the first part 6 and extends from the second part 8 at the same time.

Figure 2:
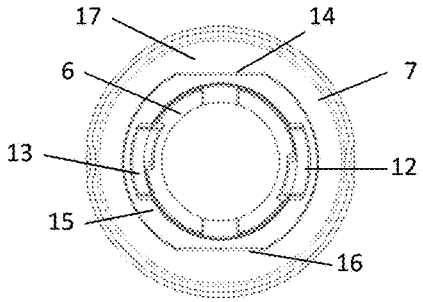
FIG. 2 is a schematic cross section through a container for cosmetic product according to one embodiment of the invention.
Figure 5:
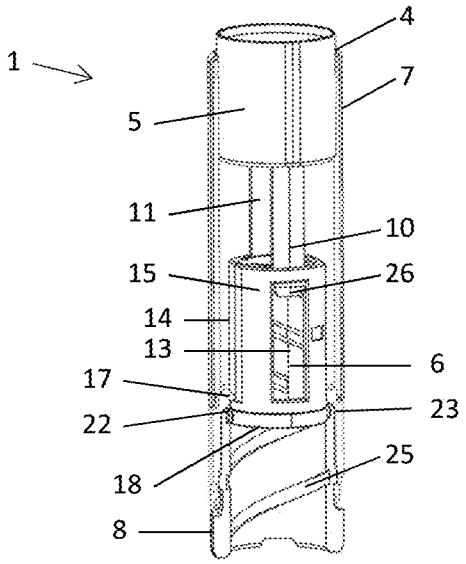
FIG. 5 is a schematic perspective view of the interaction between the cup, the first element and the second element between the intermediate position and the application position.

However, the movable element 15 and the slides 12, 13 are fixed to the receptacle 3 for rotation therewith, but are free in translation. To this end, said movable element 15 is provided with two planar faces 14, 16 that are designed to be in contact with a rim 17 of the body 7 of the receptacle 3, as shown in FIGS. 2 and 5. The rim 17 extends over the circumference of the space in the receptacle 3 in order to be in contact with the two planar faces 14, 16 so as to inhibit the rotation of the movable element 15. Thus, since the periphery of the movable element 15 is not completely circular, it cannot turn in the receptacle 3 and is therefore rotated by the receptacle 3 at the same time and in the same movement thereof. The rim 17 is arranged in the body 7 at the level of the movement means 2, above the second part 8.

In FIGS. 4(*b*) and 5, the movable element 15 guides the cup 5 in the receptacle 3. To this end, the two slides 12, 13 can each interact with a stud 24, 26 that is in each case arranged on a tab 10, 11 of the cups. Therefore, the stud 24, 26 can slide in the corresponding slide 12, 13 such that the cup 5 is locked in rotation relative to the body 7 of the receptacle 3, but is movable in translation in the body 7. The slides 12, 13 thus transform the spiral movement of the tabs 10, 11 of the cup 5 about the first part 6 into a translational movement when the receptacle 3 is rotating relative to the first part 6.

As shown in FIG. 6(*a*), each extension tab 10, 11 of the cup 5 is therefore provided with a protuberance 19, 21 and a stud 24, 26 that are each located on either side of the end said tab, the protuberance 19, 21 interacting radially inwards with the first thread 20 of the first part 6 (shown in FIG. 6(*c*)) and the stud 24, 26 interacting radially outwards with the slide 12, 13 of the movable element 15 (shown in FIG. 6(*b*)).

Between the storage position and the intermediate position, the movable element rotates the cup 5 by means of the slides 12, 13, which drive the studs 24, 26 locked in rotation in the slides 12, 13. Thus, the protuberances 19, 21 follow the rotation and are forced to travel along the first thread 20. The cup 5 therefore moves at first only in translation, between the storage position and the intermediate position.

Furthermore, the slides 12, 13 are preferably closed at each end such that the studs 24, 26 of the tabs 10, 11 are blocked at the ends of the slides 12, 13, in particular to keep the protuberances 19, 21 in the first thread 20. Therefore, the tabs 10, 11 of the cup 5 are retained at the end of the spiral movement when the cup 5 is in the intermediate position or in the application position, in particular so that the cup 5 and the first part 6 remain mechanically connected by the tabs 10, 11.

In the same way, and as shown in FIG. 5, the rim 17 transforms the spiral movement of the first part 6 in the second part 8 into a translational movement during the movement between the intermediate position and the application position, the first part 6, the cup 5 and the movable element 15 therefore being interlinked without a degree of freedom.

The rim 17 is also used to retain and block the first part 6 and the movable element 15 at the end of the travel, when they are protruding from the second part 8 in the application position, as shown in FIG. 5. For this purpose, the base 18 of the first part 6 has a larger diameter than the space left by the rim 17. However, the remainder of the first part 6 has a smaller diameter so that it can pass through the rim 17 in order to emerge from the second part 8. The same applies to the bottom of the movable element 15, which is wider so as to be retained by the rim 17.

The movable element 15 is therefore a retractable guide means, which avoids having guide means that take up more width in the receptacle, in particular with the slides along the body, and which reduce the width of the space for cosmetic product. Thus, the container can contain a cosmetic product that is more bulky than a container having the same diameter.

Furthermore, the movable element 15 makes it possible for the above-described tabs to be used for guiding purposes. Therefore, there is no need for a second pair of extension tabs on the cup 15, this second pair of tabs interacting with slides which are arranged on the body inside the container. Furthermore, by means of the movable element 15 and the telescopic guide means, the extension tabs 10, 11 are shorter than those having stationary slides.

Advantageously, the first part 6 and the second part 8 are each provided with through-holes, which each open out opposite one another, such that it is possible to refill the receptacle 3 with product through said holes. In order to make this refilling possible, the extension tabs 10, 11 are preferably located at a distance from the axis of the receptacle so as to leave sufficient space for introducing the product. Furthermore, said cup 5 is provided with an orifice opening out opposite the holes in the first part and the second part in order to allow the product to travel towards the cups during the refilling.

In a second embodiment (not shown in the drawings), the first part is capable of moving simultaneously in rotation and in translation between a first position in which the second part is substantially inserted into the first part and a second position in which the second part is substantially protruding from first part. In other words, in this embodiment, the first part is wider than the second part. The first part moves around the second part between the intermediate position in which the first part surrounds the second part and the application position in which the first part no longer substantially surrounds the second part.

Furthermore, in order to keep the cosmetic product protected when it is not in use, the container is advantageously provided with a removable cover (not shown in the drawings) for closing the orifice in the receptacle. To this end, the cover and the receptacle are provided with conventional removable joining means, for example by fitting the cover to the receptacle. Thus, when the stick of lipstick is inside the receptacle, the cover can be positioned on the receptacle to close the opening.

The invention claimed is:

1. Container for cosmetic product, comprising a receptacle provided with an inner space, the container comprising a cup designed to receive said product, the container further comprising a first part and a second part which move the cup and are coaxial with the cup along an axis of the receptacle, the cup, the first part and the second part being interlinked in a telescopic movement along said axis;

wherein the cup comprises at least one extension tab that is capable of interacting with the first part, the extension tab enabling the movement of the cup relative to the first part to be controlled;

wherein the first part comprises a first thread that is capable of interacting with a protuberance arranged on the extension tab, the sliding of said protuberance in the first thread controlling the movement of the cup relative to the first part; and wherein the first part and the second part are each provided with through-holes, which each open out opposite one another, the first thread being arranged on the outer surface of the first part.

2. Container according to claim 1, wherein the tab(s) is/are located at a distance from said axis of the receptacle and said cup is provided with one or more orifices opening out opposite the holes in the first part and the second part.

3. Container according to claim 1, wherein the container further comprises a second thread arranged on the second part, the second thread being capable of interacting with a protrusion arranged on the first part to enable the first part to move relative to the second part.

4. Container according to claim 1, comprising a slide that is capable of interacting with a stud arranged on the cup, the slide(s) being substantially fixed to the receptacle for rotation therewith.

5. Container according to claim 1, comprising a slide that is capable of interacting with a stud arranged on the cup, the slide(s) being substantially fixed to the receptacle for rotation therewith, wherein the protuberance and the stud are located on either side of an end of said extension tab, the tab being able to move in a space located between the movable first part and the slide.

6. Container according to claim 4, comprising a movable element provided with the slide(s), the movable element being fixed on the one hand to the first part for movement in translation therewith and fixed on the other hand to the receptacle for rotation therewith.

7. Container according to claim 6, wherein said movable element is provided with at least one planar surface in contact with a rim of the receptacle in order to stop it from turning inside the receptacle.

8. Container according to claim 6, wherein the movable element is free to rotate about the first part.

9. Container according to claim 7, wherein the movable element is arranged around the first part.

10. Container according to claim 1, wherein the first part and the second part are arranged at one end of the receptacle, the second part being able to be actuated from outside the receptacle.

11. Container according to claim 1, wherein the receptacle is cylindrical.

12. Container according to claim 1, wherein the first part and the second part are cylindrical.

* * * * *